US005123180A

United States Patent [19]

Nannig et al.

[11] Patent Number: 5,123,180

[45] Date of Patent: Jun. 23, 1992

[54] COMPOSITE INSOLE

[75] Inventors: Urban R. Nannig, 300 Old Baptist Rd, North Kinstown, R.I. 02852; William H. Cochran, South Kingstown, R.I.

[73] Assignee: Urban R. Nannig, North Kingstown, R.I.

[21] Appl. No.: 685,463

[22] Filed: Apr. 12, 1991

[51] Int. Cl.[5] ..... A43B 13/38; A43B 23/00

[52] U.S. Cl. ..... 36/43; 36/76 C; 36/93

[58] Field of Search ..... 36/44, 43; 128/581

[56] References Cited

U.S. PATENT DOCUMENTS 4,520,581 6/1985 Irwin et al. ..... 36/93 X
4,580,356 4/1986 David ..... 36/43
4,651,445 3/1987 Hannibal ..... 36/103
4,756,096 7/1988 Meyer ..... 36/43 X
4,774,954 10/1988 Ibrahim ..... 36/44 X
4,791,736 12/1988 Phillips ..... 128/586 X

*Primary Examiner*—Paul T. Sewell
*Assistant Examiner*—BethAnne Cicconi
*Attorney, Agent, or Firm*—Barlow & Barlow, Ltd.

[57] ABSTRACT

Insole formed as a composite of a network of reinforcing fibers embedded in a matrix of a thermoplastic material having a softening temperature in the order of 90° C. and retains its softening for a reasonable time at a lower temperature that is not uncomfortable to the human skin. The insole is formed to the shape of the bottom of the wearer's foot by placing it while still soft in the shoe and allowing it to harden while being subjected to the wearer's standing weight.

6 Claims, 1 Drawing Sheet

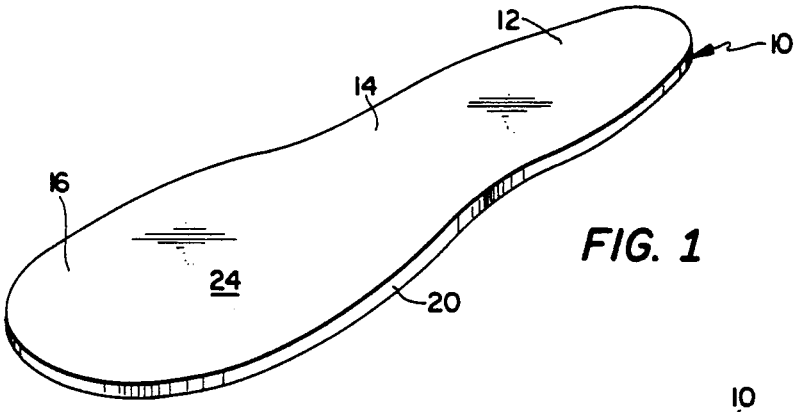
FIG. 1
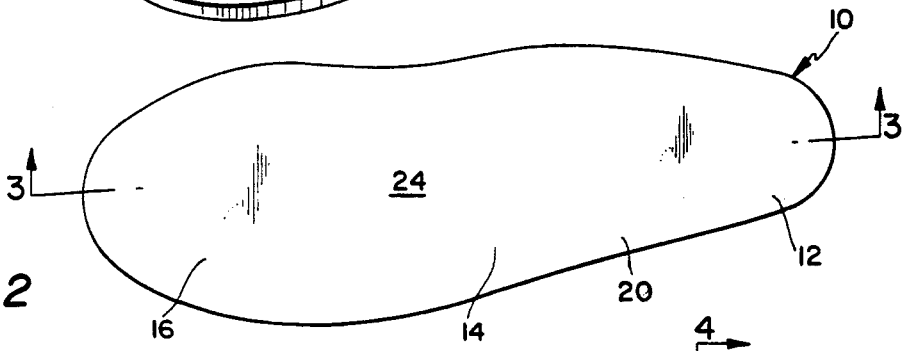
FIG. 2
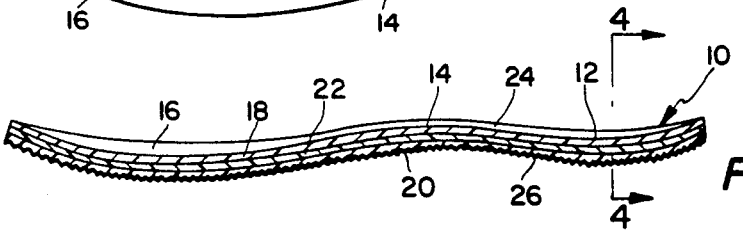
FIG. 3
FIG. 4
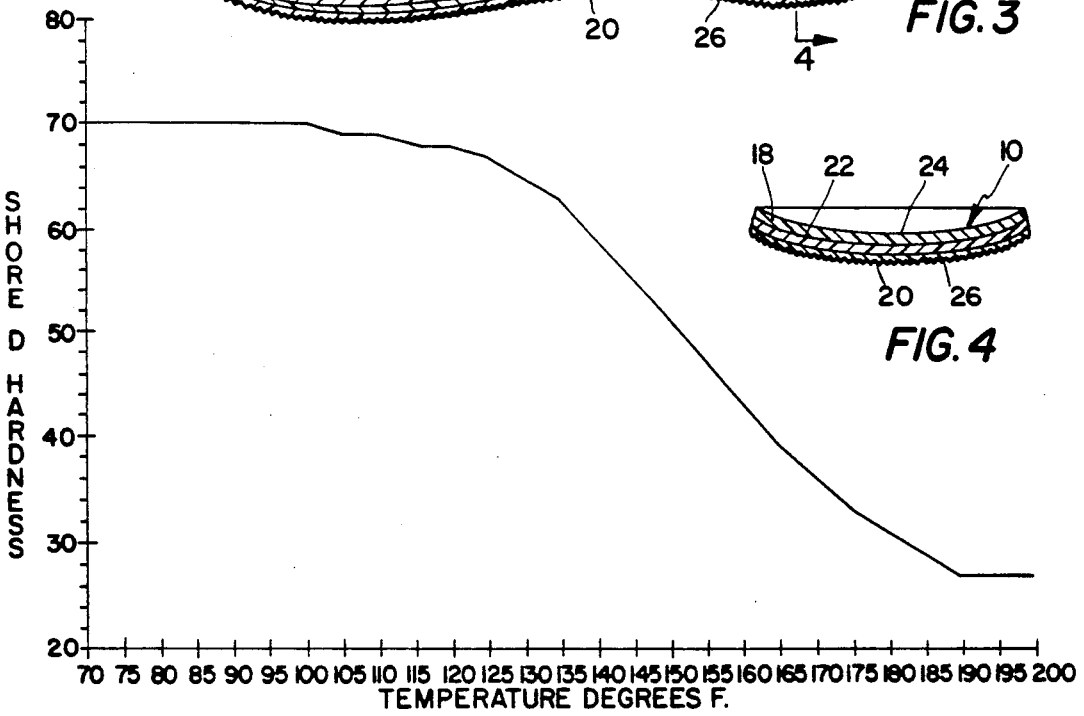
FIG. 5

COMPOSITE INSOLE

BACKGROUND OF THE INVENTION

In the design and manufacture of running shoes, the emphasis has always been on providing a sole which absorbs the shock of running. In a shoe that is not custom-made, it has been necessary to compromise somewhat on the shape of the inner surface of the sole. For that reason, researchers have sought an ideal method of adjusting the shape of the inner surface of the sole to fit individuals. The obvious system involves providing an insole that can adjust itself to the shape of the individual foot. Therefore, the prior art discloses a number of insoles that are designed to be customized to an individual foot. For example, the U.S. Pat. No. 3,407,406 describes a shoe pad filled with microspheres which deform to fit the foot. The U.S. Pat. Nos. 2,794,270 and 3,903,621 disclose shoe linings containing semi-liquid moldable materials. However, constructions such as these cannot provide adequate support for a foot, since they continue to change shape under the pressures exerted by the wearer's foot during use. It is also well-known to inject liquid resin into a boot and to allow it to set while the wearer's foot is in position in the boot. This system is particularly used in connection with ski boots and, in theory, gives ideal support. In practice, however, such a liner is restricting, rather than supportive, and fails to allow for normal flexing of the foot during use.

It can be seen, then, that existing insoles tend to attenuate the forces associated with walking and running, whether they are incorporated in the shoe or are removable. The intensity of such forces is reduced, because of energy absorption by the material of which the insole is made.

Cellular materials are widely used in existing insoles, because they have actual (or are perceived to have) good energy absorption. Cellular materials, however, are characterized by poor dimensional stability, so that the end product may be flexible and wrinkle-free, but the necessary thickness of cellular materials is a disadvantage, since the shoe must be more voluminous in the vertical direction to accommodate such thick insoles. Furthermore, as such thickness increases, resistance to toppling ("support") decreases. Fabric surfaces are used widely in existing insoles, because they impart actual or perceived comfort, durability, color, or graphics. However, such fabrics are characterized by poor dimensional stability, so that the end product is undesirably flexible and is not wrinkle-free. Stiffness has never been desirable, because of discomfort and user fatigue. Wrinkling is to be avoided, also, because of discomfort and wear to the product as the pressure of the foot is concentrated during running on the lines of the wrinkles. Similarly, soiling is concentrated by the hills and valleys of the wrinkles.

In existing insoles, attenuation is limited to the volume of the insole affected by the associated forces. The rates of force transmission and the dimensions of the affected volume tend to be low. Accordingly, the decrease in intensity is not effective over a large area of the foot. The characteristics of the materials result in low transmission distances and velocities, these characteristics being notable in the low modulus of flexible cellular materials and the yarn geometry of fabric surfacing materials. Pigments tend to abrade off these materials when they flex during use. In the known insoles, the direction of force transmission is not controlled effectively. The rates and the quantities transmitted tend to be equal in every direction through the insoles and away from said forces. Thus, the forces are transfered through existing insoles to the foot in greater density near the site of said forces on the insole and the dispersal of said forces is poor.

Higher modulus materials are not used in existing insoles, because of their poor flexibility or tendency to crack at high loads, these all being negative attributes. Existing insoles have little puncture resistance, so that anything puncturing the outsole tends to puncture the insole also. Closed-cell cellular materials tend to rupture during use in existing insoles and to become open cells; this diminishes their attenuation capacity. These and other difficulties experienced with the prior art devices have been obviated in a novel manner by the present invention.

It is, therefore, an outstanding object of the invention to provide an insole that is especially fitted to the person who is to use the shoe.

Another object of this invention is the provision of an insole which is extremely thin, but which offers substantial support to the foot.

A further object of the present invention is the provision of an insole that offers greater sliding between the insole and the stocking than exists between the stocking and the foot, thus preventing the development of blisters.

A still further object of the invention is the provision of an insole that is simple and rugged in design, which can be readily manufactured, and which is capable of a long life of useful service.

It is a further object of the invention to provide an insole which has a high modulus of elasticity, but which will not develop cracks or form wrinkles.

Another object of the invention is the provision of an insole which is thin, which is supportive of the foot, which is comfortable, which is durable, which is capable of bearing permanent graphics, which is wrinkle-free, which is capable of dispersing forces rapidly, and which is broadly inclusive of some high-modulus material. The invention has the attributes of being foot-shock protective, foot-wear protective, crack free, and puncture resistant.

With these and other objects in view, as will be apparent to those skilled in the art, the invention resides in the combination of parts set forth in the specification and covered by the claims appended hereto.

SUMMARY OF THE INVENTION

In general, the present invention relates to a customized insole which is easily fitted, is comfortable, and is supportive in terms of biomechanical principles. The invention includes a sheet of thermoplastic material that has a softening point temperature that is above room temperature, but which material does not have the ability to retain heat as a heat sink. In this way, it may be safely brought into the shoe and the human foot may be placed in contact with it. The material has a thickness such that it is moldable by normal foot pressure when maintained at the softening point thereof. The insole is characterized by having a smooth upper surface and a rough lower surface; the smooth upper surface is advantageous in not creating blisters, since the foot may slide thereon readily, while the rough lower surface assures that the insole not slide over the inside surface of the shoe.

More specifically, the insole is made of a composite with a network of reinforcing fibers embedded therein in such a way that the insole absorbs the shock and distributes the impact of the foot laterally, i.e., between the medial and lateral sides, during athletic activity. The process for forming the insole is also part of the invention and consists basically of the steps of providing an insole blank as generally described above and then heating the blank in boiling water, so that it is soft and has a reduced Shore D hardness. After that, with the insole blank in place in the shoe, the wearer's foot (with a sock on it) is placed in the shoe and he stands on the insole, thereby molding the insole blank into the shape of the bottom of his foot. The insole is allowed to cool while in this position in the shoe.

BRIEF DESCRIPTION OF THE DRAWINGS

The character of the invention, however, may be best understood by reference to one of its structural forms, as illustrated by the accompanying drawings, in which:

FIG. 1 is a perspective view of an insole incorporating the principles of the present invention, FIG. 2 is a plan view of the insole, FIG. 3 is a vertical sectional view of the insole, taken on the line III—III of FIG. 2, FIG. 4 is a vertical sectional view of the insole, taken on the line IV—IV of FIG. 3, and FIG. 5 is a chart showing the manner in which the matrix material of the invention varies in hardness with changes in temperature.

DESCRIPTION OF THE PREFERRED EMBODIMENT

Referring first to FIG. 1, it can be seen that the insole, indicated generally by the reference number 10, consists of a heel section 12, an arch section 14, and a forefoot section 16. The insole is constructed in accordance with the invention of a composite which includes a matrix 20 in which is embedded a reinforcing network of fibers. The matrix consists of a thermoplastic polymer material with a softening temperature s between 50° C. (120° F.) and 100° C. (212° F.) It has a thickness in the order of 1.27 mm., so that it will not act as a heat sink and may be, therefore, safely brought into contact with the human foot without damaging the skin. The material is characterized as having a density at ambient temperature of a Shore D hardness of 70, while at the softening point, which is in the order of 90° C., the density will have a Shore D hardness of approximately 28.

In the preferred embodiment, the material of the matrix 20 is polyurethane with the network in the form of fibers dispersed throughout the matrix. It is in the form of a substantially unified blank with a thickness in the order of 0.5 to 2.5 mm, provided with a smooth upper surface 24 and a roughened lower surface 26. The composite has a network 18 of fibers that operate as reinforcing means, which network has the ability to transmit quickly any load that is placed on it. The individual fibers of the network are suitably oriented and are in continuous filament form, so that the load is dispersed laterally from the medial to the lateral side of the insole. For the purpose of ease of material handling, it may be convenient to make up the network in the form of one or more fabrics. The composite, therefore, consists essentially of a polyurethane matrix in which is dispersed a multi-axis, multi-layer network of reinforcing fibers, which network may be arranged generally on the bias. The insole is formed by the application of polyurethane reactants about the fiber's component in situ. Typically, the polyurethane component comprises (A) a moderate molecular weight difunctional polyester resin, such as 1,6 hexane diol/ neopentyl glycol adipate, (B) polypropylene glycol ether, and (C) cycloaliphatic diol, such as cyclohexanedimethanol. This combination of diols are cross-linked by the use of polypropylene tryol and reacted with diphenylmethylene diisocyanate to form polyurethane. Catalyst may be added to accelerate the polymer formation reaction.

The insole 10 is intended to be provided to the user in blank form, so that he can first cut a paper pattern to the profile of the insole surface of his shoe and then transfer the pattern to the composite blank. He then cuts the blank to the proper profile, trimming it as necessary to fit the shoe. Once the fit has been properly obtained, the insole is placed in boiling water for 2 or 3 minutes until softened. The insole is then removed from the water, using a pair of tongs, and placed immediately in the shoe with the smooth surface 24 uppermost and the rough surface 26 facing downwardly. The matrix 20 is, at this point, quite soft, since it has a Shore D hardness of about 30, as indicated in the chart in FIG. 5. The user, with his socks on, puts on his shoe and stands up with his full weight on his feet until the insole cools. After one shoe and insole has been completed, the procedure is repeated for the other foot. After about 5 minutes has elapsed, the insole material has cooled sufficiently to retain its desired shape and has been permanently formed to that shape. The finished insole is firm, suitably resilient, and flexible.

The operation and advantages of the present invention will now be readily understood in view of the above description. The placement of the insole 10 in an athletic shoe serves to provide an ideal cushion for the foot, particularly when placed under the stress of athletic activity. The smooth upper surface 24 allows the user's foot to slide without difficulty; since blisters are usually caused by relative sliding between the foot and the sock. Since the necessary movement of the foot during running is absorbed by the sliding between the sock and the insole, it can be seen that damage to the foot from this source is prevented. The presence of the network 18 within the matrix 20 has a number of beneficial effects. First of all, when the matrix is soft during the forming process, the network maintains the structural integrity of the insole by, particularly, preventing lateral extrusion. Secondly, during the use of the insole, the network helps give the composite the desired stiffness for supporting the foot. Because the network is incorporated into the matrix in such a way as to almost completely fill it, the fibers prevent the formation of cracks by limiting any extension of incipient cracks that can form under extreme stress. The insole constructed in accordance with the invention is not only light in weight, so that it can be used with athletic shoes without adding undesirable weight, but is tough enough to prevent any puncture (from road debris, for instance) from penetrating as far inwardly as the foot.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A cured composite insole blank having a heel section, an arch section, a forefoot section and medial and lateral sides, the insole blank being formed as a composite with a matrix of a fully reacted thermoplastic material having a network of reinforcing fibers, said fibers being arranged generally on the bias direction of the insole blank, said matrix having a Shore D hardness of approximately 70 at ambient temperature, said insole blank softening between 50° C. and 100° C., wherein the stressed insole blank distributes the load laterally to the medial and lateral sides.

2. A composite insole blank as recited in claim 1, wherein the insole blank has a smooth upper surface and has a uniform thickness in the order of 0.5 to 2.5 mm.

3. A composite insole blank as recited in claim 1, wherein the network is dispersed throughout the entire thickness of the insole blank.

4. A composite insole blank as recited in claim 1, wherein the reinforcing fibers are high tenacity fibers.

5. A flexible composite insole blank, comprising a network of reinforcing fibers dispersed in a fully reacted thermoplastic matrix having a thickness in the order of 1.3 mm. and a Shore D hardness of 70 at room temperature, which matrix softens to a Shore D hardness of approximately 30 at a temperature above 90° C., whereby the softened insole blank may readily conform to the bottom of a human foot when heated and, yet, prevent discomfort while being molded to the sole of a foot.

6. A process for forming an insole, comprising the steps of:

providing a cured insole blank as claimed in claim 1, heating the blank above the softening point temperature of the matrix, placing the blank in a shoe with which it is to be used, placing the wear's foot in the shoe, so that the insole blank is sandwiched between the wear's foot and the inside of the shoe, standing so that the normal foot pressure is exerted on the insole blank, while allowing the molded insole blank to cool with the foot in place, whereby the insole blank is molded into the shape of the bottom of the foot of the wearer.

* * * * *